US010415233B2

(12) United States Patent
Nicolas

(10) Patent No.: US 10,415,233 B2
(45) Date of Patent: Sep. 17, 2019

(54) DEVICE AND METHOD FOR KEEPING WATER AWAY FROM A CONCRETE SLAB SITTING ON A FOOTING

(71) Applicant: Marcel Nicolas, Grande-Rivière (CA)

(72) Inventor: Marcel Nicolas, Grande-Rivière (CA)

( * ) Notice: Subject to any disclaimer, the term of this patent is extended or adjusted under 35 U.S.C. 154(b) by 0 days.

(21) Appl. No.: 16/157,028

(22) Filed: Oct. 10, 2018

(65) Prior Publication Data

US 2019/0040624 A1 Feb. 7, 2019

Related U.S. Application Data

(60) Continuation-in-part of application No. 14/546,004, filed on Nov. 18, 2014, now Pat. No. 10,174,478, which is a division of application No. 14/058,840, filed on Oct. 21, 2013, now abandoned.

(51) Int. Cl.
*E04B 1/70* (2006.01)
*E02D 27/02* (2006.01)
*E02D 31/00* (2006.01)

(52) U.S. Cl.
CPC ..... *E04B 1/70* (2013.01); *E02D 27/02* (2013.01); *E02D 31/00* (2013.01); *E04B 1/7038* (2013.01)

(58) Field of Classification Search
CPC ..... E04B 1/70; E04B 1/6803; E02D 31/02; E02D 27/02; E02D 27/32; E02D 27/48; E02D 31/008; E02D 31/06; E02D 31/10
See application file for complete search history.

(56) References Cited

U.S. PATENT DOCUMENTS 2,378,995 A * 6/1945 Freeman ..... E02D 27/48 405/230
3,304,672 A * 2/1967 Bakke ..... E04B 1/7023 52/169.5
3,413,769 A * 12/1968 Hoyt ..... E04B 1/7023 52/198
3,426,487 A * 2/1969 Forte ..... E02D 31/02 137/360
3,427,810 A * 2/1969 Petersen ..... E02B 11/00 405/43
3,725,185 A * 4/1973 Curtis ..... E02D 31/02 442/27
3,850,193 A * 11/1974 Guzzo ..... E02D 29/16 137/362
3,852,925 A * 12/1974 Gazzo ..... E04B 1/7023 52/302.3

(Continued)

*Primary Examiner* — James M Ference
(74) *Attorney, Agent, or Firm* — Praxis

(57) ABSTRACT

A device and method for keeping water away from a main concrete slab sitting on a concrete footing of a building include a joint covering an intersection of the external side surface of the foundation wall and the top surface of the footing. The joint can include a plurality of wedge blocks positioned adjacent the intersection providing an inclined surface for the water to flow away from the intersection, and typically one water resistant membrane ensuring the impermeability of the joint. Alternatively, the device and method include at least one through hole extending through the footing, and sloping downwardly from the internal side surface to the external side surface, and below the top surface of the footing, to drain water away from the area under the slab. A drain pipe may also be inserted into the hole.

20 Claims, 8 Drawing Sheets

(56) References Cited

U.S. PATENT DOCUMENTS 4,075,800 A * 2/1978 Molick ..... E04B 1/6803 137/362
4,136,500 A * 1/1979 DiFiore ..... E04B 1/7023 52/169.14
4,245,443 A * 1/1981 Beechen ..... E04B 1/7023 52/169.5
4,265,062 A * 5/1981 Klibofske ..... E04B 1/0007 52/169.11
4,265,064 A * 5/1981 Parezo ..... E02D 31/02 52/169.14
4,271,648 A * 6/1981 Johnson ..... E04B 1/7023 52/169.5
4,309,855 A * 1/1982 Pate ..... E02D 31/02 405/45
4,333,281 A * 6/1982 Scarfone ..... E02D 31/02 52/169.5
4,381,630 A * 5/1983 Koester ..... E04B 1/7023 52/169.5
4,486,986 A * 12/1984 Cosenza ..... E02D 31/02 405/229
4,538,386 A * 9/1985 DiCello ..... E02D 31/02 405/43
4,541,479 A * 9/1985 Bergeron, Jr. ..... F24D 11/009 126/400
4,612,742 A * 9/1986 Bevilacqua ..... E02D 31/02 52/169.5
4,660,333 A * 4/1987 Romer ..... E02D 31/02 52/169.9
4,706,418 A * 11/1987 Stewart ..... E04D 13/17 405/43
4,757,651 A * 7/1988 Crites ..... E02D 31/02 137/362
4,856,240 A * 8/1989 McHale ..... E04B 1/648 52/169.14
4,858,521 A * 8/1989 Heh ..... E02D 31/008 454/344
4,898,494 A * 2/1990 Ellis ..... E02B 11/00 285/148.22
5,044,821 A * 9/1991 Johnsen ..... E02D 31/02 405/50
5,054,252 A * 10/1991 Newman ..... E02D 31/008 52/169.14
5,145,291 A * 9/1992 Bullivant ..... E02D 5/38 405/230
5,158,399 A * 10/1992 Flores ..... E02D 17/04 405/262
5,367,842 A * 11/1994 Janesky ..... E04B 1/7023 52/169.5
5,399,050 A * 3/1995 Jacobus ..... E02D 27/00 249/13
5,495,696 A * 3/1996 Repka ..... E02D 31/02 405/229
5,501,044 A * 3/1996 Janesky ..... E04B 1/7023 404/4
5,535,556 A * 7/1996 Hughes, Jr. ..... E04B 1/0007 405/229
5,551,797 A * 9/1996 Sanford ..... E02D 31/02 405/36
5,630,299 A * 5/1997 Jackman ..... E04B 1/7023 405/36
5,634,311 A * 6/1997 Carlton ..... E02B 11/005 285/903
5,694,723 A * 12/1997 Parker ..... E02D 27/32 404/4
5,749,182 A * 5/1998 Vavrinak ..... E02D 31/02 52/169.14
5,771,643 A * 6/1998 Parker ..... E02D 27/32 404/8
5,845,456 A * 12/1998 Read ..... E02D 31/02 52/741.11
5,884,439 A * 3/1999 Hess, III ..... E02D 27/02 248/188.4
5,931,603 A * 8/1999 Swain ..... E04B 1/70 405/229
5,932,646 A * 8/1999 Roberts ..... C08K 5/01 524/476
5,979,123 A * 11/1999 Brockman ..... A01M 1/24 49/58
6,132,139 A * 10/2000 Hashimoto ..... A01G 22/22 405/104
6,205,720 B1 * 3/2001 Wolfrum ..... E04B 1/34342 52/169.12
6,230,468 B1 * 5/2001 Klaus ..... E02D 31/06 405/39
6,238,766 B1 * 5/2001 Massett ..... E02D 31/02 405/270
6,382,237 B1 * 5/2002 Takai ..... E03B 3/02 137/236.1
6,453,628 B2 * 9/2002 Traxler ..... A01M 1/24 52/169.14
6,546,679 B1 * 4/2003 Bushberger ..... B32B 7/12 428/343
6,561,732 B1 * 5/2003 Bloomfield ..... E02B 11/005 138/125
6,598,360 B1 * 7/2003 Pratt ..... E02D 31/02 52/169.5
6,619,001 B1 * 9/2003 Pratt ..... E02D 31/02 52/169.5
6,634,144 B1 * 10/2003 Moore ..... E02D 31/02 405/38
6,676,506 B2 * 1/2004 Steneby ..... E02D 31/02 454/186
6,766,620 B2 * 7/2004 Robbins ..... E02D 31/10 405/129.5
6,948,287 B2 * 9/2005 Korn ..... E04B 1/68 277/510
7,062,885 B1 * 6/2006 Dickenson, Jr. ..... E02D 27/02 52/274
7,137,225 B2 * 11/2006 Zuppan ..... E02D 27/02 52/169.14
7,181,888 B1 * 2/2007 Facaros ..... E02D 31/02 52/169.5
7,818,925 B2 * 10/2010 Benedict ..... E02D 27/02 52/169.5
7,980,035 B1 * 7/2011 D'Apolito ..... E04B 1/7069 52/198
8,186,127 B1 * 5/2012 Pratt ..... E02D 31/02 52/169.5
8,209,915 B2 * 7/2012 O'Leary ..... E04B 1/625 52/293.3
8,297,005 B1 * 10/2012 Bramble ..... E02D 31/002 52/169.5
8,312,682 B2 * 11/2012 Trotter ..... E04B 1/7023 52/169.5
2002/0032998 A1 * 3/2002 Morello ..... E02D 27/02 52/426
2002/0096881 A1 * 7/2002 DeSanto, Sr. ..... F16L 5/00 285/192
2002/0152696 A1 * 10/2002 Ruiz ..... E04B 1/7023 52/169.5
2002/0154951 A1 * 10/2002 Gamache ..... E02B 11/00 405/43
2002/0187005 A1 * 12/2002 Le Blanc ..... E02D 31/02 405/36
2003/0115814 A1 * 6/2003 Nielsen ..... E03F 5/0406 52/302.1
2003/0219315 A1 * 11/2003 Adams ..... E02D 29/02 405/229
2004/0076473 A1 * 4/2004 Burkhart ..... E03F 1/005 405/36
2005/0196577 A1 * 9/2005 Riste ..... E02D 31/02 428/76
2005/0218270 A1 * 10/2005 Doverspike ..... F16L 1/09 248/65
2006/0096186 A1 * 5/2006 Safie ..... E02D 29/0258 52/169.5
2006/0096204 A1 * 5/2006 Martens ..... E02D 27/02 52/293.3

(56) References Cited

U.S. PATENT DOCUMENTS

| | | | | |
|---|---|---|---|---|
| 2006/0112653 | A1* | 6/2006 | Hogenson | E02D 31/02 52/169.5 |
| 2007/0068093 | A1* | 3/2007 | Grange | E02D 31/02 52/97 |
| 2007/0094952 | A1* | 5/2007 | Niemczyk | E02D 31/02 52/169.5 |
| 2008/0104909 | A1* | 5/2008 | Wallin | E02D 29/0275 52/293.1 |
| 2008/0110114 | A1* | 5/2008 | Lane | E02D 27/02 52/293.2 |
| 2008/0295439 | A1* | 12/2008 | Janesky | E04B 1/7023 52/589.1 |
| 2012/0102851 | A1* | 5/2012 | Scarfo | E04B 1/7023 52/169.5 |
| 2012/0167503 | A1* | 7/2012 | Suzuki | E02D 27/00 52/292 |
| 2013/0175427 | A1* | 7/2013 | Moyher | E02D 19/00 249/18 |
| 2014/0161539 | A1* | 6/2014 | Arya | E02D 5/18 405/229 |

* cited by examiner

DEVICE AND METHOD FOR KEEPING WATER AWAY FROM A CONCRETE SLAB SITTING ON A FOOTING

CROSS REFERENCE TO RELATED APPLICATIONS

The present patent application is a Continuation-In-Part of U.S. patent application Ser. No. 14/546,004 filed on Nov. 18, 2014, which is a division of parent U.S. patent application Ser. No. 14/058,840 filed on Oct. 21, 2013, both of which are being included herein by reference.

FIELD OF THE INVENTION

The present invention relates to concrete foundations, and more specifically to a device and method for keeping water away from a main concrete slab sitting on a footing on the inside relative to the foundation walls.

BACKGROUND OF THE INVENTION

The accumulation of water under a concrete slab (generally sitting on the inside portion of a concrete footing structure, relative to the concrete foundation walls) of a building can generate major problems to the building structure, without accounting for discomforts the building resident has to deal with. Water under a concrete slab, usually considered as the basement floor of the building, causes a high level (higher than normal comfortable level) of moisture, which might eventually dampen sections of the floor finishing and/or lower regions of walls. Other problems may occur on the concrete foundation itself. This water can get to the concrete slab by infiltration between the foundation walls and the footing.

All these problems are even more present when there is a positive pressure (hydro-pressure) under the slab. Such water can be stagnant and remain under the slab for extensive periods of time, if not permanently, depending on the soil type. Since there is no real access under the slab, there is no efficient way to get rid of the above-mentioned problems associated with the presence of water or moisture, other than breaking the slab to access the soil underneath. Alternatively, some have tried to drain such water by reaching the area from underneath the footing, but this could induce local displacement (collapsing, falling) of the footing, which will generate even more problematic situations to the structure of the building.

Water can also reach the concrete slab from the interface between the foundation walls and the footing supporting the walls, with the concrete of the foundation walls not fully adhering to the footing, thereby leaving some interstices for water to reach the slab. Furthermore, since the concrete is known to be somewhat porous, it is further easy for water often accumulating at the outer periphery of the footing to slowly flow along the unsealed interface and reach the slab sitting on the inner periphery of the footing. Water easily enters the intersection when accumulated onto the top surface of the footing. This is especially the case when the outside top surface of the footing is slightly inclined downwardly towards the foundation wall, which case is much more frequent than one may think (as if the weight of the concrete slab resting on the footing inside the foundation walls, in addition to a movable ground surface under the footing, would be the main reason of this downward and inward inclination of the footing). This inclination of the footing often breaks the key formed along the interface with the foundation walls, thus allowing the water or moisture to infiltrate therethrough and allow for the local raising of the concrete slab under the hydro pressure.

Accordingly, there is a need for an improved device and method for keeping water away from a main concrete slab.

SUMMARY OF THE INVENTION

It is therefore a general object of the present invention to provide an improved device and method for keeping water away from a main concrete slab.

An advantage of the present invention is that the device/method prevents the water from entering the intersection between the footing and the foundation wall sitting thereon and reaching the main concrete slab, by sealing the intersection while ensuring a positive slope for the water to flow away therefrom, either using concrete joint (which preferably requires a skilled technician) or relatively easily installed wedge blocks to form the joint.

Another advantage of the present invention is that the device/method allows the water to move away from the concrete slab through a plurality of drain pipes extending through openings into the footing from an area under the slab to an area exterior to the footing, while preferably preventing water from entering into the pipes and flowing back towards the slab.

A further advantage of the present invention is that the device/method allows for the drainage of water accumulated, and typically pressurized (hydro pressure), under an existing concrete slab without having to break or damage the slab, as well as for the continuous drainage of future water reaching the area under the slab, such as after a heavy rain fall or the like, such as to eliminate any possible local raising of the concrete slab. The present device/method further prevents any water accumulation and/or stagnation under the concrete slab and at the footing and foundation wall interface.

Still another advantage of the present invention is that the device/method allows for an air venting of the area under the slab after any water has been drained away.

Yet another advantage of the present invention is that the device/method is preferably retrofitted into an already existing building or could eventually installed during construction phase of a new building under-ground foundation.

According to an aspect of the present invention there is provided a device for keeping water away from a main concrete slab partially sitting on an inside edge of a top surface of a footing and adjacent a foundation wall entirely sitting on the top surface of the footing adjacent the slab, the foundation wall having an external side surface facing away from the slab and an internal side surface facing towards the slab, the top surface having an outside edge thereof extending externally away from the external side surface and defining an external ledge of the footing therebetween, said device comprising:

a substantially solid joint adapted to be located adjacent and along an intersection of the external side surface of the foundation wall and the top surface of the footing, the joint entirely and sealably covering the intersection, and adapted to cover a first portion of the external side surface adjacent the intersection and at least a portion of the external ledge adjacent the intersection, said joint defining a free surface angled relative to both the external side surface and the top surface, in a cross section of the joint, the free surface, the first portion of the external side surface and the portion of the external ledge forming a substantially triangular shape;

wherein the joint closes off the intersection to keep water away therefrom and from the concrete slab.

Typically, the device further includes an external water resistant membrane adhering to and covering the free surface and a second portion of the external side surface adjacent and above the first portion thereof.

Conveniently, the device includes a structural rod adapted to be located adjacent and along the intersection, the structural rod being entirely covered by the joint.

Conveniently, the device includes a plurality of spacers for spacing the structural rod from the foundation wall and the footing, said plurality of spacers being entirely covered by the joint.

Conveniently, the plurality of spacers are anchors for anchoring the structural rod to foundation wall and the footing.

Conveniently, the joint is made out of settable concrete material.

In one embodiment, the joint includes at least one wedge block.

Conveniently, the at least one wedge block includes a plurality of wedge blocks positioned in a side-by-side relationship relative to one another.

In one embodiment, the device further includes an attaching member for attaching said at least one wedge blocks to at least one of the footing and the foundation wall.

Conveniently, the device further includes a fastener member securing adjacent ones of said plurality of wedge blocks to one another.

Conveniently, the fastener member is a staple-type fastener.

Conveniently, the fastener member includes two tenon members facing one another, each said tenon member having a stem member extending longitudinally away from the other said tenon member and having a lateral extension member extending generally perpendicularly from said stem member, each said tenon member being engageable into a corresponding mortise opening extending into one of said adjacent ones of said plurality of wedge blocks.

Alternatively, fastener member includes at least one tenon member extending away from one said adjacent wedge blocks, said tenon member having a stem member extending longitudinally away from said one said adjacent wedge blocks and having a lateral extension member extending generally perpendicularly from said stem member, said tenon member being engageable into a corresponding mortise opening extending into the other one of said adjacent wedge blocks.

In one embodiment, the free surface of said at least one wedge block is angled relative to the first portion of the external side surface with an angle being larger than zero degree and smaller than 90 degrees, and preferably the angle is between about 60 and about 80 degrees.

In one embodiment, the device includes an external water resistant membrane adhering to and covering the free surface and a second portion of the external side surface adjacent and above the first portion thereof.

In one embodiment, the device includes an internal water resistant membrane adhering to and covering the external ledge, the first portion and a second portion of the external side surface adjacent and above the first portion thereof.

Conveniently, the device further includes an external water resistant membrane adhering to and covering the free surface and the internal water resistant membrane covering the second portion of the external side surface.

Conveniently, at least one of the internal and external water resistant membranes extending upwardly above a ground level and/or downwardly below the outside edge.

According to another aspect of the present invention there is provided a method for keeping water away from a main concrete slab partially sitting on an edge of a top surface of a footing and adjacent a foundation wall entirely sitting on the top surface of the footing adjacent the slab, the foundation wall having an external side surface facing away from the slab and an internal side surface facing towards the slab, the top surface having an external protrusion thereof extending externally away from the external side surface and defining an external ledge of the footing therebetween, the external side surface of the foundation wall and the top surface of the footing defining an intersection therebetween, said method comprising the step of:

closing off the intersection to keep water away therefrom and from the concrete slab.

Typically, the step of closing off the intersection includes:

covering the intersection with a substantially solid joint, the joint being adapted to cover a first portion of the external side surface adjacent the intersection and at least a portion of the external ledge adjacent the intersection, said joint defining a free surface angled relative to both the external side surface and the top surface, in a cross section of the joint, the free surface, the first portion of the external side surface and the portion of the external ledge forming a substantially triangular shape.

Conveniently, the joint generally covers the entire external ledge of the footing.

In one embodiment, the step of covering the intersection includes pouring settable concrete material over the intersection to form a solid piece of concrete being the joint.

Conveniently, the method further includes, before covering the intersection, the step of installing a structural rod adjacent and along the intersection, and the step of covering the intersection further includes entirely covering the structural rod with the settable concrete material.

Conveniently, the step of installing a structural rod includes spacing the structural rod from the foundation wall and the footing using a plurality of spacers.

Conveniently, the method of claim 8, further includes, after the step of covering the intersection, the step of covering the free surface and a second portion of the external side surface adjacent and above the first portion thereof with an external water resistant membrane adhering thereto.

In one embodiment, the step of covering the intersection includes installing at least one wedge block over the intersection to form the joint.

Conveniently, the at least one wedge block includes a plurality of wedge blocks, and wherein the step of covering the intersection includes installing the plurality of wedge blocks over the intersection in a side-by-side fashion to form the joint.

Conveniently, the step of installing includes securing adjacent ones of said plurality of wedge blocks to one another using a fastening member.

In one embodiment, the step of installing includes attaching said at least one wedge block to at least one of the footing and the foundation wall with an attaching member.

In one embodiment, the method further includes, after the step of covering the intersection, the step of covering the free surface and a second portion of the external side surface adjacent and above the first portion thereof with an external water resistant membrane adhering thereto.

In one embodiment, the method further includes, before the step of installing at least one wedge block, the step of covering the external ledge, the first portion and a second portion of the external side surface adjacent and above the first portion thereof with an internal water resistant membrane adhering thereto.

Conveniently, the method further includes, after the step of installing at least one wedge block, the step of covering the free surface and the internal water resistant membrane covering the second portion of the external side surface with an external water resistant membrane adhering thereto.

Conveniently, at least one of the internal and external water resistant membranes extending upwardly above a ground level and/or downwardly below the outside edge.

According to another aspect of the present invention there is provided a device for keeping water away from a main concrete slab partially sitting on an edge of a top surface of a footing and adjacent a foundation wall sitting on the top surface of the footing, the footing having an external side surface facing away from the slab and an internal side surface facing towards the slab, said device comprising:

at least one through hole extending through the footing from the internal side surface to the external side surface, and below the top surface, the at least one through hole sloping downwardly from the internal side surface to the external side surface;

wherein the at least one through hole allows water to flow therethrough from an interior area located adjacent the internal side surface of the footing and below the concrete slab to an exterior area located adjacent the external side surface of the footing to keep water away from the concrete slab.

Conveniently, the at least one drain pipe is received within the at least one through hole, the at least one drain pipe sloping downwardly from the internal side surface to the external side surface, the at least one drain pipe including a plurality of drain holes extending through a wall thereof.

Conveniently, the at least one drain pipe is sealably received within the at least one through hole.

Conveniently, the at least one drain pipe has a pointy inner end thereof extending away from the footing into the interior area.

Conveniently, the at least one drain pipe has an outer end thereof extending away from the footing into the exterior area, said outer end including a check valve so as to prevent any solid and/or fluid from entering into the at least one drain pipe from the outer end.

Conveniently, the outer end is located adjacent the external side surface of the footing.

Alternatively, the at least one drain pipe includes a plurality of longitudinal sections connecting to each other into an end-to-end configuration.

Conveniently, the plurality of longitudinal sections connect to each other into the end-to-end configuration with a screw type manner.

Conveniently, each of the plurality of longitudinal sections includes a plurality of drain holes extending through a wall thereof.

Alternatively, a check valve is located inside the at least one through hole adjacent the external side surface so as to prevent any solid and/or fluid from entering into the at least one through hole from the exterior area.

Conveniently, the device includes a vent pipe extending from the interior area through the footing and along the foundation wall adjacent the external side surface to above a ground level adjacent the foundation wall.

According to another aspect of the present invention there is provided a method for keeping water away from an existing main concrete slab partially sitting on an edge of a top surface of an existing footing and adjacent an existing foundation wall sitting on the top surface of the existing footing, the existing footing having an external side surface facing away from the existing concrete slab and an internal side surface facing towards the existing concrete slab, said method comprising the step of:

draining water away from an interior area located adjacent the internal side surface of the existing footing and below the existing concrete slab to an exterior area located adjacent the external side surface of the existing footing to keep water away from the existing concrete slab.

Typically, the step of draining water includes drilling at least one through hole extending through the existing footing from the internal side surface in fluid communication with the interior area to the external side surface in fluid communication with the exterior area, the at least one through hole sloping downwardly from the internal side surface to the external side surface.

Conveniently, the method further includes, after the step of drilling at least one through hole, the step of installing at least one drain pipe through along the at least one through hole of the existing footing from the internal side surface to the external side surface, and below the top surface, with the at least one drain pipe sloping downwardly from the internal side surface to the external side surface.

Conveniently, the step of installing at least one drain pipe includes:

trimming an outer end of the at least one drain pipe extending away from the existing footing into the exterior area adjacent the external side surface; and installing a check valve at the outer end of the at least one drain pipe so as to prevent any solid and/or fluid from entering into the at least one drain pipe from the exterior area.

Conveniently, the method includes, after the step of drilling at least one through hole, the step of installing a check valve inside the at least one through hole adjacent the external side surface so as to prevent any solid and/or fluid from entering into the at least one through hole from the exterior area.

Conveniently, the at least one drain pipe includes a plurality of longitudinal sections connecting to each other into an end-to-end configuration, and wherein the step of installing at least one drain pipe includes:

axially inserting a first one of the plurality of longitudinal sections into the at least one through hole; and connecting a successive one of said plurality of longitudinal sections to a previously inserted one said longitudinal section into an end-to-end configuration, and axially inserting the successive one of the plurality of longitudinal sections into the at least one through hole.

Conveniently, the method further includes the step of installing a vent pipe adapted to vent gas away from the interior area, the vent pipe extending from the interior area through the existing footing and along the existing foundation wall adjacent the external side surface to above a ground level adjacent the existing foundation wall.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE INVENTION

With reference to the annexed drawings the preferred embodiments of the present invention will be herein described for indicative purpose and by no means as of limitation.

Figure 1:
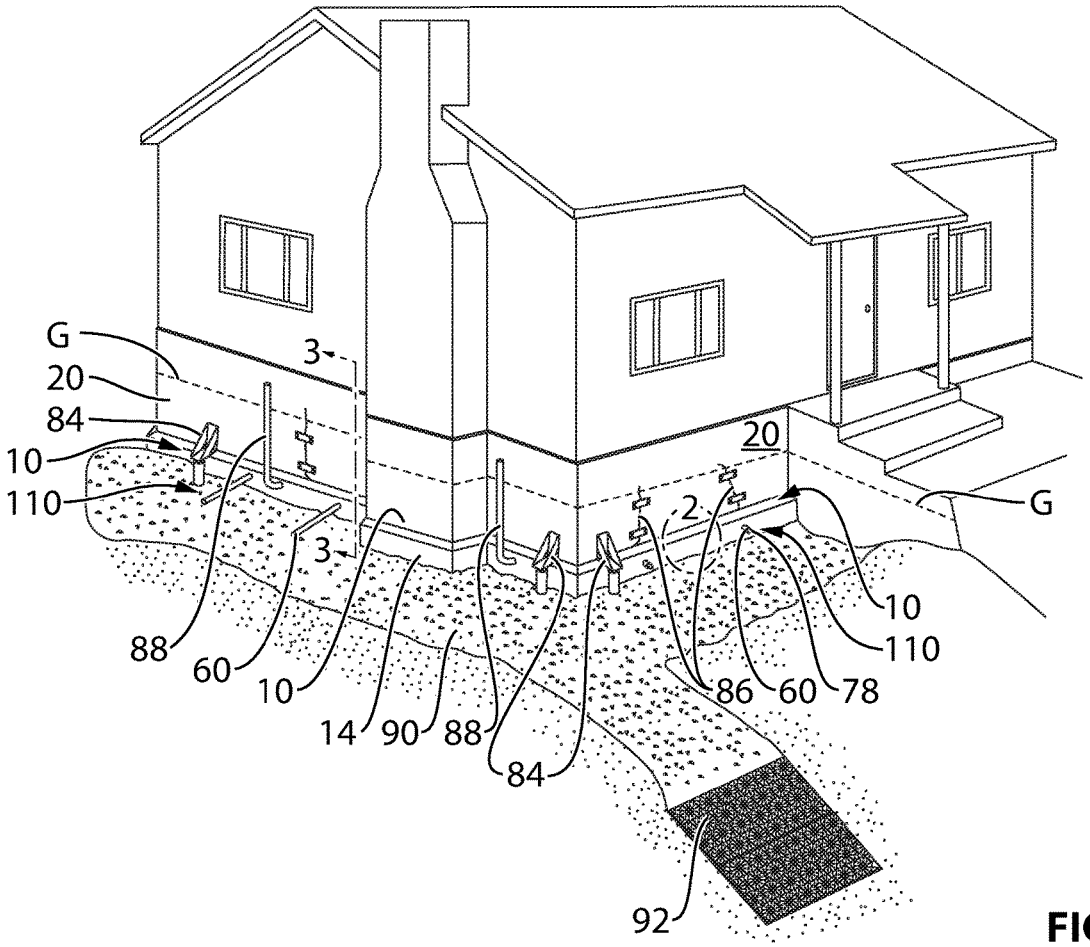
FIG. 1 is a broken perspective view of devices for keeping moisture/water away from a main concrete slab of a building sitting on a footing in accordance with embodiments of the present invention.
Figure 2:
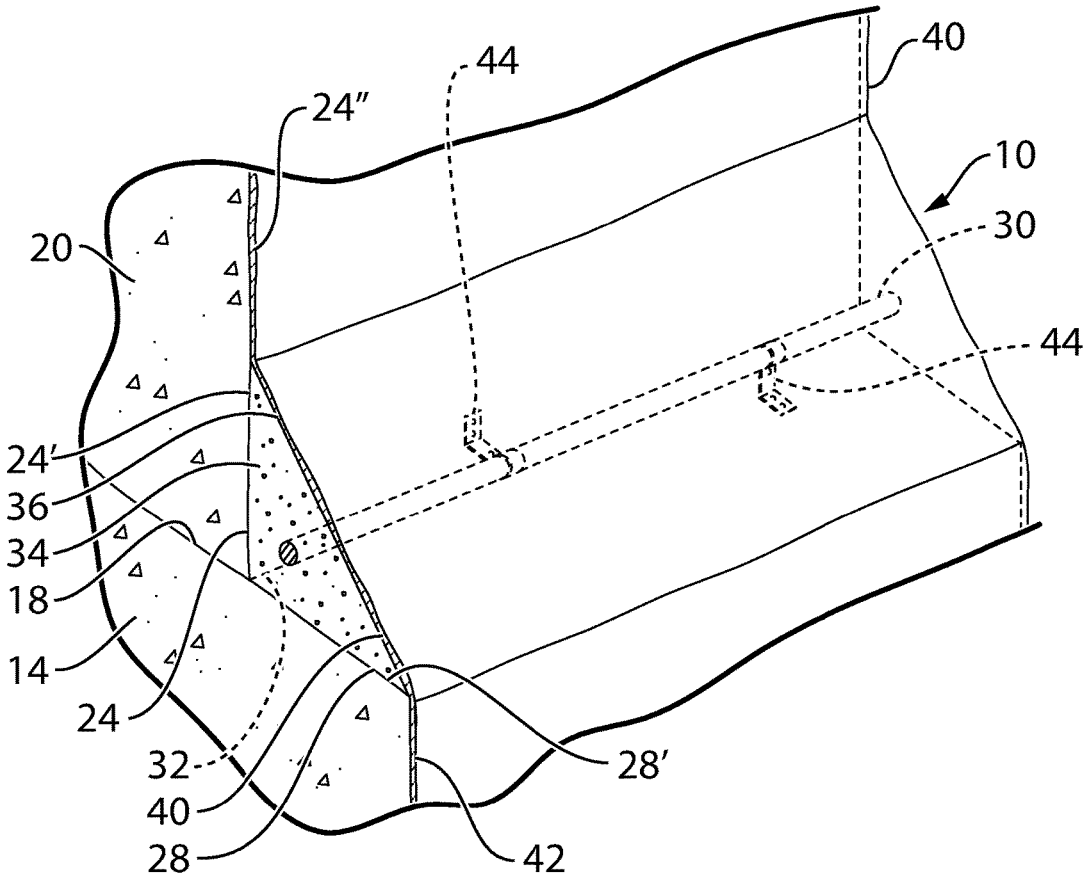
FIG. 2 is an enlarged broken perspective view taken along line 2 of FIG. 1 showing a device for keeping water away from a main concrete slab in accordance with a first embodiment of the present invention.

Referring to FIGS. 1 to 2, there is shown a device 10 for keeping moisture/water away from a main concrete slab 12 partially sitting on a concrete footing 14 of a building 16 in accordance with an embodiment of the present invention.

The device 10 is essentially for keeping water/moisture away from the main concrete slab 12 partially sitting on an internal edge 19*i* of a top surface 18 of the footing 14, and adjacent a foundation wall 20 entirely sitting on the top surface 18 of the footing 14, typically with a key 22 at the interface there between to prevent lateral sliding of the foundation wall 20 relative to the footing 14. The foundation wall 20 has an external side surface 24 facing away from the slab 12 and an internal side surface 26 facing towards the slab 12. The top surface 18 of the footing 14 has an outside edge 19*o* thereof that extends externally away from the external side surface 24 of the foundation wall 20 and defines an external ledge 28 of the footing 14 therebetween. As shown in FIG. 1, the soil around a portion of the foundation wall 20 has been moved away or dug to leave the foundation wall 20 and a large portion of the footing 14 temporarily exposed to open air during the repairs being done.

The device 10 typically includes substantially solid joint 34 to sealably and entirely cover an intersection 32 of the external side surface 24 of the foundation wall 20 and the top surface 18 of the footing 14. The joint 34 covers a lower first portion 24' of the external side surface 24 adjacent the intersection 32 and at least a portion 28' of the external ledge 28 adjacent the intersection 32, such that it substantially closes off the intersection 32 to keep moisture/water away therefrom and from the concrete slab 12. Typically, the portion 28' is the entire ledge 28. The concrete joint 34 defines a substantially flat free surface 36 angled relative to both the external side surface 24 and the top surface 18, such that, in a cross section of the device 10, the free surface 36, the first portion 24' of the external side surface 24 and the portion 28' of the external ledge 28 form together a substantially triangular shape. The angle A of the triangular shape between the free surface 36 and the first portion 24' is substantially anywhere larger than 0 (zero) and smaller than 90 degrees typically between about 5 and about 85 degrees, and preferably between about 45 and about 80 degrees, and most preferably between about 60 and about 80 degrees.

Typically, the joint 34 also entirely covers a structural rod 30 or the like, such as for example a conventional rebar or metallic cable, located adjacent and along the intersection 32. The joint 34 is preferably made out of settable concrete material that entirely covers the structural rod 30, but could also be made of any other suitable material, preferably relatively light weight but also rigid enough not to be easily crunched, such as, for example, a pre-shaped solid foam material (as expanded polystyrene foam) or any suitable plastic-type material or the like, that could eventually be adapted to receive the structural rod 30 therein, as further described hereinbelow.

Typically, an external water resistant membrane 40 adheres to and covers the free surface 36 and at least a second portion 24" of the external side surface 24 adjacent and above the first portion 24' thereof, and preferably a portion of the footing 14 adjacent the free surface 36, such that the external membrane 40 typically covers entirely the free surface 36 and its intersections with both the external side surface 24 and the top surface 18, as shown in FIGS. 1 and 2. Additionally, for further protection of the intersection 32, the first 24' and second 24" portions of the external side surface 24 and the external ledge 18, along with the intersection 32 there between, could be covered by an internal water resistant membrane 41 (see FIG. 5).

Preferably, at least the external membrane 40, or both the internal 41 and external 40 membranes, such as a pulverized, sprayed or spread rubber type material or the like, extend upward along the external side surface 24 of the foundation wall 20 above the ground or soil level G indicated as a dotted line along the foundation wall 20. Alternatively, each of the internal 41 and/or external 40 membranes could be a plastic or rubber type material bonded or glued onto the underlying surfaces to prevent water and/or moisture infiltration there between. Obviously, especially if the membranes 40, 41 are made out of a plastic or rubber type material, the respective membrane 40, 41 could extend downward down to the external side surface 42 of the footing 14 below the outside edge 19*o*.

Typically, the structural rod 30 is spaced from both the foundation wall 20 and the footing 14 via a plurality of spacers 44 or the like that could also be used without the rod 30. Typically, the spacers are anchors 44 used to hold the structural rod 30 spaced from at least the foundation wall 20, and preferably also from the footing 14. The plurality of anchors 44 are also entirely covered by the concrete joint 34 and are used to secure the joint 34 adjacent the intersection 32.

Figure 5:
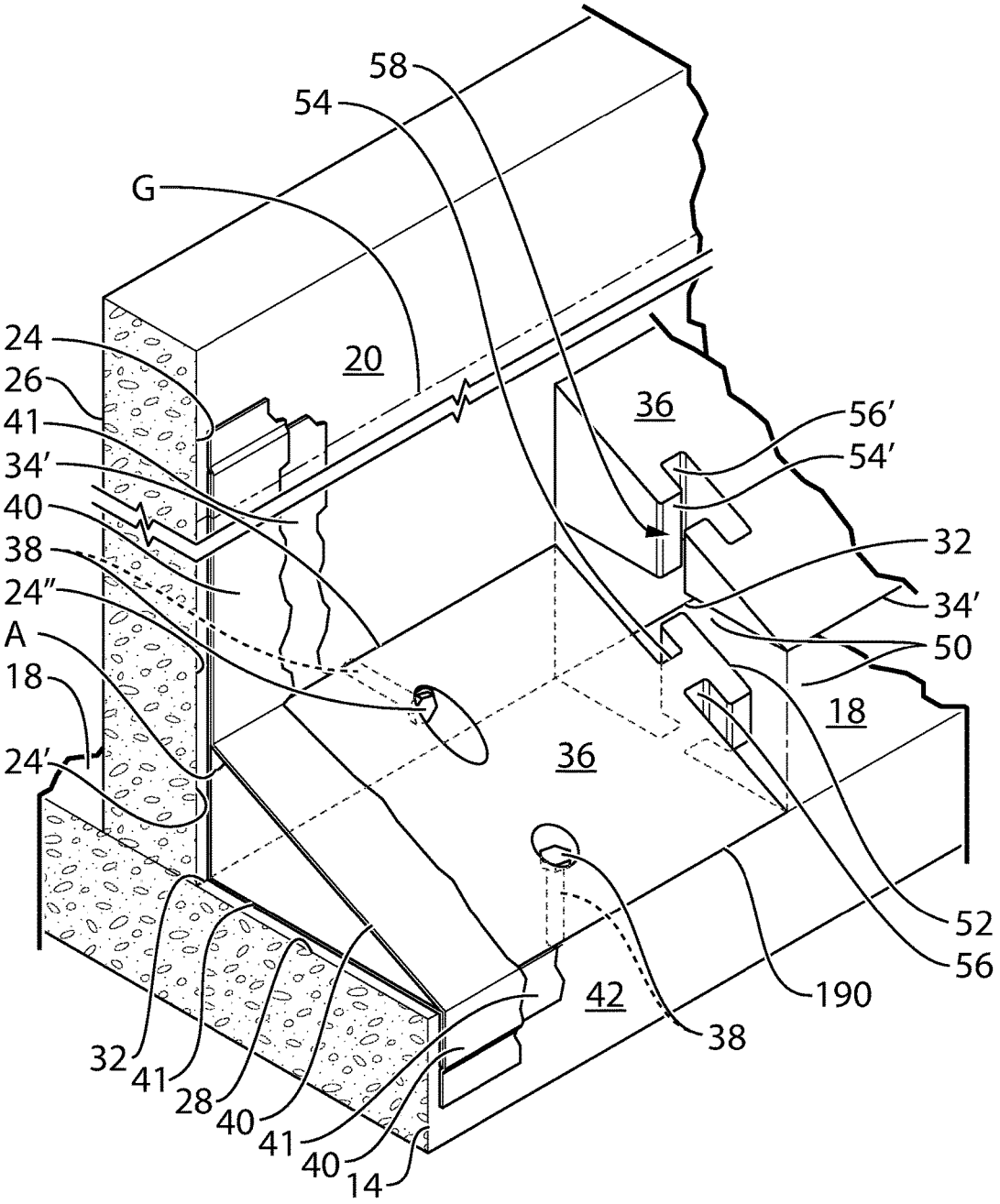
FIG. 5 is a view similar to FIG. 2, showing device for keeping water away from a main concrete slab in accordance with another embodiment of the present invention.
Figure 6:
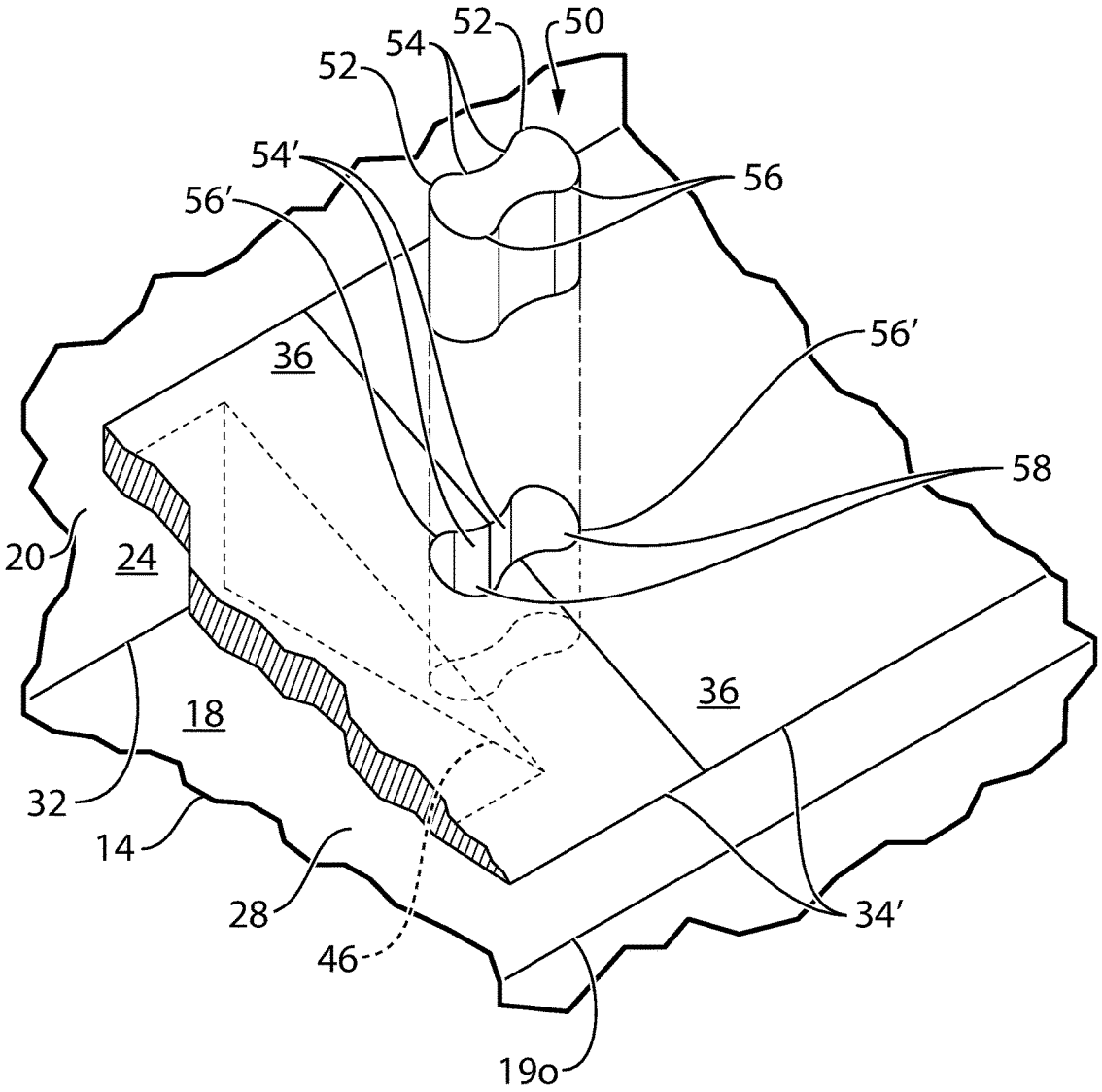
FIG. 6 is a view similar to FIG. 5, showing another embodiment of a fastener member securing two adjacent wedge blocks to one another.
Figure 7:
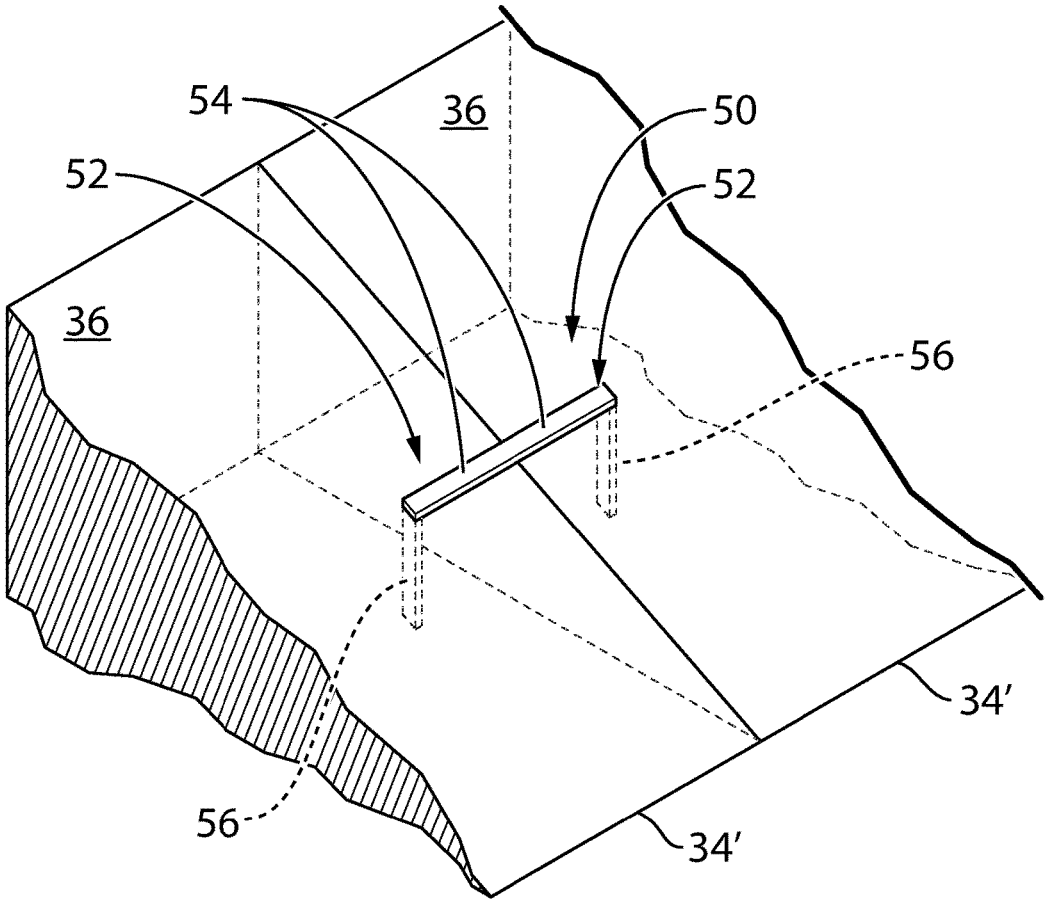
FIG. 7 is a view similar to FIG. 6, showing another embodiment of a staple-type fastener securing two adjacent wedge blocks to one another.

Alternatively, as shown in FIGS. 5 to 7, the device 10 can be made of at least one, but preferably a plurality of wedge blocks 34' positioned in a side-by-side relationship or fashion relative to one another.

Typically, in order to hold, maintain or secure the wedge blocks 34" to at least one of the footing 14 and preferably the foundation wall 20 adjacent the intersection 32, especially when earth or gravel is poured thereon to fill the opening adjacent the foundation wall 20 up to the ground level G after the installation of the device 10 is completed, an attaching member 38 (see FIG. 5), such as a concrete screw or the like is used. Conveniently, depending on the dimensions of each wedge block 34", only some of them would need to be secured with an attaching member 38, such as, for example, every two or three wedge blocks 34".

In order to hold, maintain or secure the adjacent wedge block 34' to one another, the device 10 includes a fastener member 50 such as a staple-type fastener. The fastener member 50 includes at least one, but preferably two tenon members 52 facing one another (see FIG. 6). Each tenon member 52 has a stem member 54 extending longitudinally away from the other tenon member 52 (or protruding away from the wedge block 34'—see FIG. 5) and has a lateral protrusion or extension member 56 that extends generally perpendicularly from the stem member 54. Alternatively, the extension member 56 could simply be a lateral enlargement (or widening) of the stem member 54 in a direction extending away from the other tenon member 52 or the wedge block 34'. Each tenon member 52 is slidably engageable into a corresponding mortise opening 58 extending into the adjacent wedge block 34'. The mortise opening 58 includes a stem section 54' and a protrusion section 56' to receive the stem member 54 and the extension member 56 therein, respectively. The extension member 56 laterally protrudes form the stem member 54 to prevent the two adjacent wedge blocks 34' from moving away from each other.

Preferably, as seen in FIG. 7, the staple-type fastener 50 has the overall shape similar of a metallic staple for paper sheets and can be simply punched or forced into the foam material of the two adjacent wedge blocks 34'.

Also, as illustrated in FIG. 6, the other surfaces of each wedge block 34' generally facing the external side surface 24 and the external ledge 28 could be generally solid and flat, but could also be only partially filled, such as legs 46 (shown in stippled lines) of the wedge block 34', formed by recesses or cavities extending internally therefrom, supporting the free surface 36.

Figure 8:
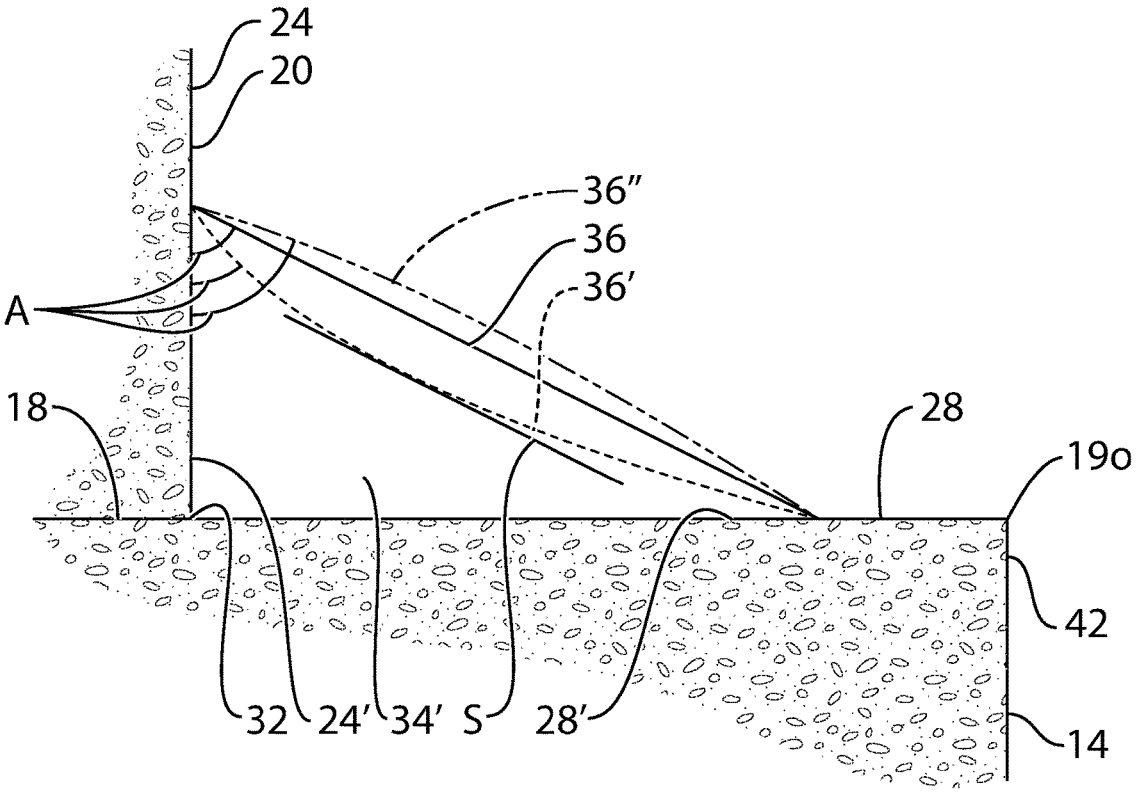
FIG. 8 is a broken section view illustrating different shapes of the angled free surface of the joints between the foundation wall and the footing.

Also, as illustrated in FIG. 8, although the free surface 36 is generally flat, it could have any curvature between its edges adjacent the external side surface 24 and the external ledge 28 such as being concave 36' or convex 36", as long as there is no hollow in which water could accumulate therein. In other words, the angle A or slope S of the free surface 36, at any point thereof, although it may angularly vary, is always oriented downwardly from the edge adjacent the external side surface 24 to the edge adjacent the external ledge 28.

The above device 10 can be installed either retroactively onto an existing building or during the construction thereof.

A corresponding method for keeping moisture/water away from the main concrete slab 12 partially sitting on an internal edge of the top surface 18 of a concrete footing 14 and adjacent a foundation wall 20 entirely sitting on the top surface 18 of the footing 14 adjacent the slab 12. The method comprises the step of closing off the intersection 32 to keep water away therefrom and from the concrete slab 12, which typically includes covering, preferably entirely, the intersection 32 with a substantially solid joint 34 that defines a free surface 36 angled relative to both the external side surface 24 and the top surface 18. The covering of the intersection 32 typically includes pouring settable concrete material over the intersection 32 to form a solid piece of concrete being the joint 34.

Typically, the method further includes, before covering the intersection, the step of installing a plurality of spacers 44 adjacent and along the intersection 32 at least on one, but preferably both the footing 14 and the foundation wall 20, and the step of covering the intersection 32 further includes entirely covering the spacers 44, with, for example, settable concrete material or pre-shaped foam material or the like.

Typically, the step of installing the plurality of spacers 44 includes installing and securing/anchoring a structural rod 30 onto at least one of the foundation wall 20 and the footing 14 using the plurality of anchors 44 to preferably space the structural rod 30 from the foundation wall 20 and the footing 14.

The method typically further includes the step of covering the free surface 36 and a second portion 24" of the external side surface 24 adjacent and above the first portion 24' thereof with an external water resistant membrane 40 adhering thereto. The second portion 24" and the external water resistant membrane 40 extending upwardly above a ground level G.

Alternatively, the covering the intersection 32 includes installing at least one wedge block 34' over the intersection 32 to form the joint, and preferably a plurality of wedge blocks 34' over the intersection in a side-by-side fashion.

Typically, the installing includes securing adjacent ones of the plurality of wedge blocks 34" to one another using a fastening member 50, as above described.

Typically, the installing includes attaching or securing at least one of the plurality of wedge blocks 34" to at least one of the footing 14 and preferably the foundation wall 20 using an attaching member 38, such as a concrete screw or the like to secure the at least one wedge block 34" adjacent the intersection 32.

Also, the method could include either or both the covering of the external ledge 28, the first portion 24' and the second portion 24" of the external side surface 24 with an internal water resistant membrane 41 adhering thereto, and the covering of the free surface 36 and the internal water resistant membrane 41 or the second portion 24" of the external side surface 24 with an external water resistant membrane 40 adhering thereto. At least the external membrane 40, or both the internal 41 and external 40 membranes preferably extend upward along the external side surface 24 of the foundation wall 20 above the ground or soil level G, and/or downward along the external side surface 42 below the outside edge 19*o*.

Now referring more specifically to FIGS. 1, 3, 4*a* and 4*b*, there is shown a device 110 for keeping moisture/water away from a main concrete slab 12 partially sitting on a concrete footing 14 of a building 16 in accordance with another embodiment of the present invention.

The device 110 includes at least one drain pipe 60 adapted to be received within a through hole 62 extending through the footing 14 from an internal side surface 26 thereof facing towards the slab 12 to the external side surface 42, and below the top surface 18. The drain pipe 60 obviously slopes downwardly from the internal side surface 26 to the external side surface 42, to allow water to flow there through, by gravity, from an interior area 66 located adjacent the internal side surface 62 of the footing 14 and below the concrete slab 12 to an exterior area 68 located adjacent the external side surface 42 of the footing 14 to keep moisture/water accumulated just below the concrete slab 12 away therefrom. In some cases, only the through hole 62, being in fluid communication with both the internal 66 and external 68 areas, is enough to drain the water away from the internal area 66.

Typically, the drain pipe 60 is sealably received within the corresponding through hole 62. In order to allow the draining of water, the drain pipe 60 typically includes a plurality of relatively small drain holes 70 extending radially through the wall of the pipe 60, and above a bottom surface 72 of the pipe 60.

In order to ease the insertion of water via the drain pipe 60 into the interior area 66, the drain pipe 60 has a typically pointy or spiky inner end 74, which extends away from the footing 14 into the interior area 66, as the tip of an arrow.

Figure 3:
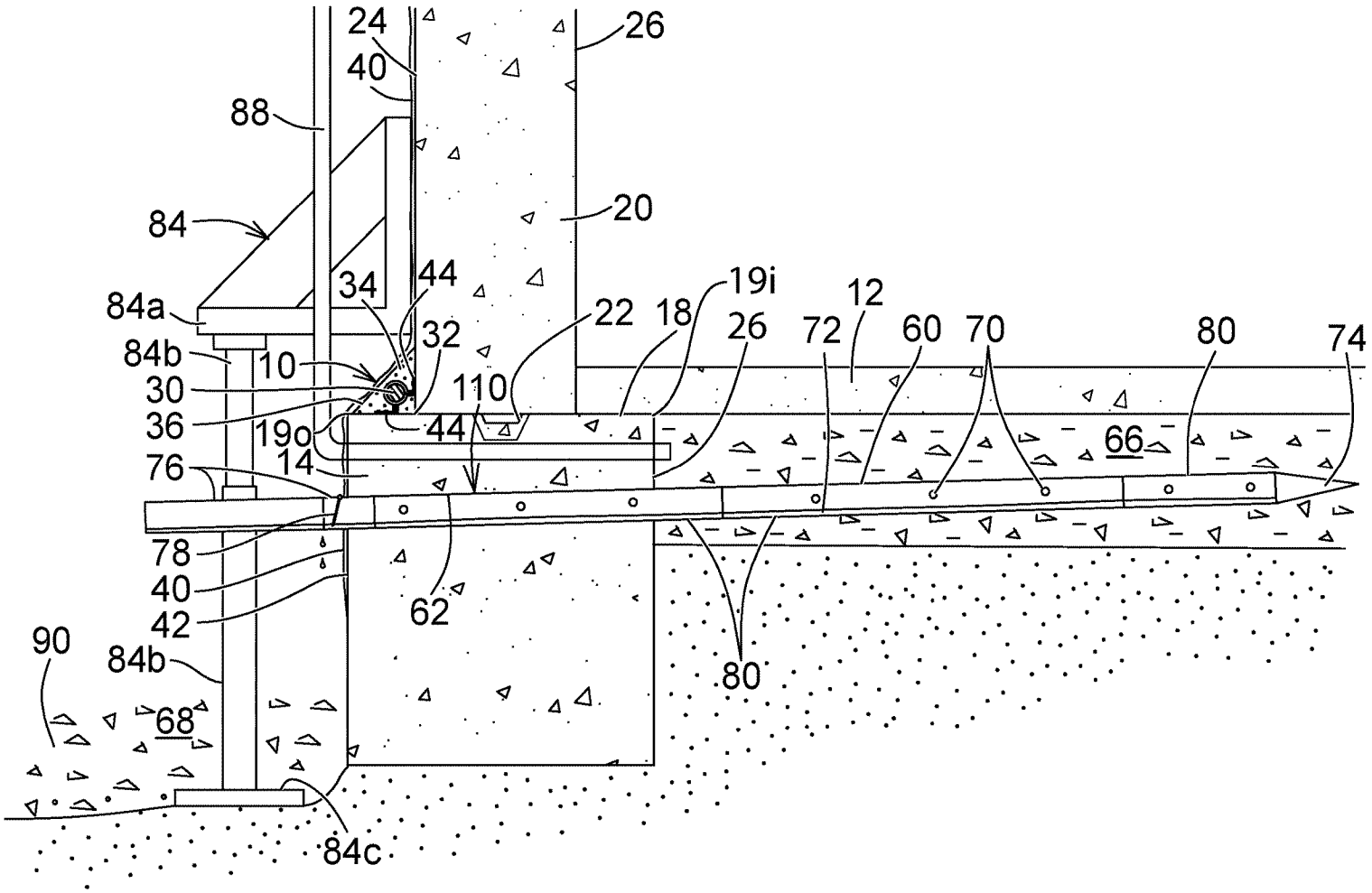
FIG. 3 is an enlarged section view taken along line 3-3 of FIG. 1; showing a second embodiment of the present invention.
Figures 4A, 4B:
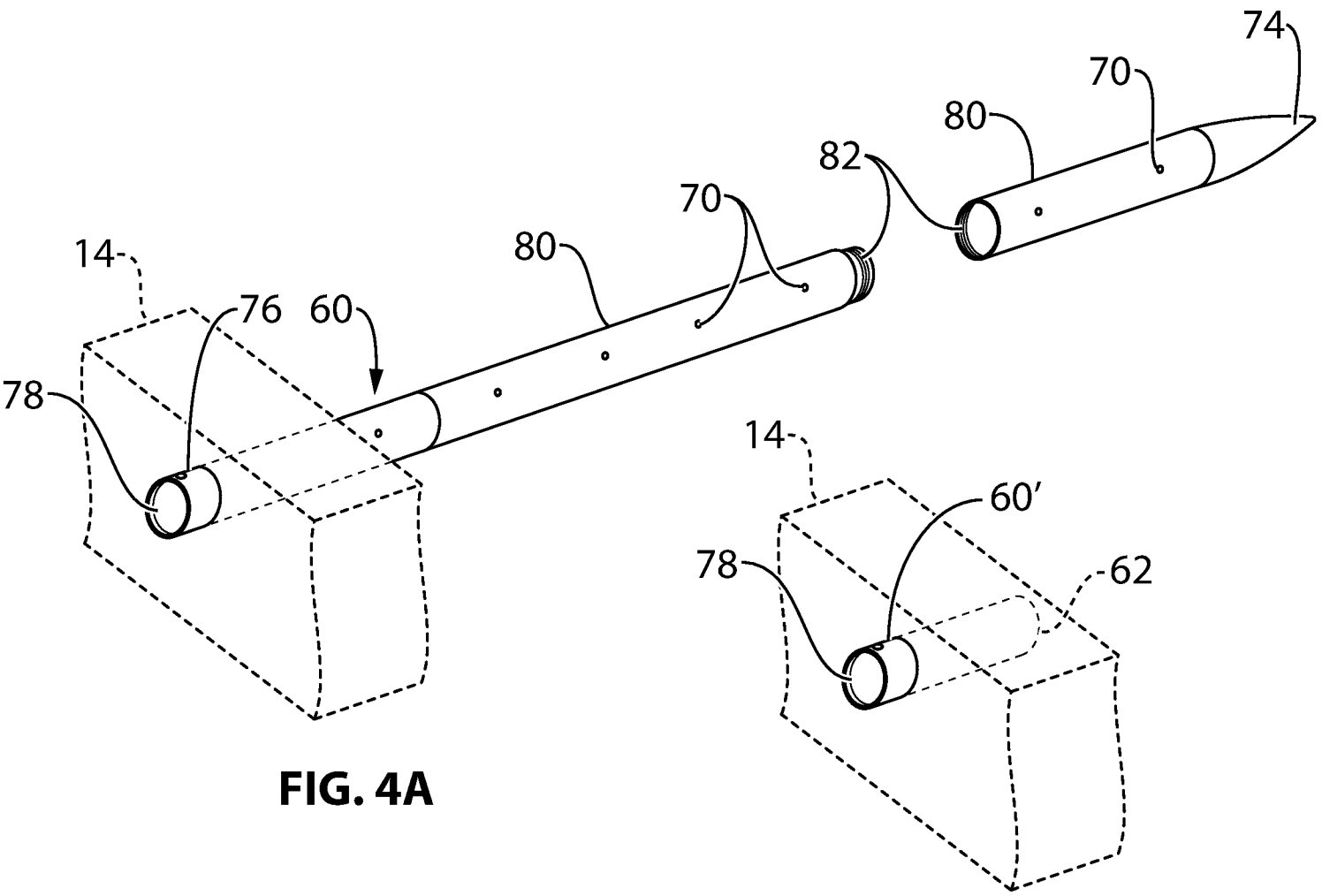
FIG. 4*a* is an enlarged exploded view of the drain pipe of FIG. 3.
FIG. 4*b* is a view similar to FIG. 4*a*, showing only a check valve installed into the through hole of the footing, without the drain pipe.

During early heavy draining, the outer end 76 of the drain pipe 60, which extends away from the footing 14 into the exterior area 68, is typically spaced from the footing 14 by a predetermined distance of preferably at least about three feet, to help draining the water away from the footing 14, as shown in dotted lines in FIGS. 1 and 3. Just before re-filling the space beside the foundation wall 24, the drain pipe is typically trimmed adjacent the external side surface 42 and closed with a flap/swing-type check valve 78 or the like, in order to prevent any solid and/or fluid from entering into the drain pipe 60 towards the interior area 66. As shown in FIG. 4*b*, when only the through hole 62 is used (without any drain pipe), or after the drain pipe 30 has been removed, the check valve 78 is located in a short pipe 60' inside the through hole 62 adjacent the external side surface 42 to prevent any solid and/or fluid from entering into the through hole 62 from the exterior area 68.

In order to ease the insertion of the drain pipe 60 into the through hole 62, the drain pipe 60 includes a plurality of longitudinal sections 80 connected to each other into an end-to-end configuration, such as with a thread fastening mechanism 82 in a screw type manner, or the like. In such a case, the drain holes 70 are located in each one of the sections 80.

A corresponding method for keeping moisture/water away from the main concrete slab 12 partially sitting on an edge of the top surface 18 of the concrete footing 14 and adjacent the foundation wall 24 sitting on the top surface 18. The method includes the step of draining water away from the interior area 66 located adjacent the internal side surface 26 of the footing 14 and below the concrete slab 12 to the exterior area 68 located adjacent the external side surface 42 of the footing 14 to keep water away from the concrete slab 12.

The step of draining water typically includes drilling at least one through hole 62 extending through the footing 14 from the internal side surface 26 in fluid communication with the interior area 66 to the external side surface 42 in fluid communication with the exterior area 68 for receiving the at least one drain pipe 60 therein, with the through hole 62 sloping downwardly from the internal side surface 26 to the external side surface 42, is typically performed.

Before the step of installing at least one drain pipe 60, there is typically the step of installing at least one drain pipe 60 along the through hole 62 of the footing 14 from the internal side surface 26 to the external side surface 42, and below the top surface 18, with the at least one drain pipe 60 sloping downwardly from the internal side surface 26 to the external side surface 42.

Preferably, the step of installing at least one drain pipe 60 includes trimming an outer end 76 of the drain pipe 60 extending away from the footing 14 into the exterior area 68 adjacent the external side surface 42; and installing a check valve 78 at the outer end 76 of the drain pipe 60.

Alternatively, after the step of drilling at least one through hole 62, there is typically the step of installing a check valve 78 inside the through hole 62 adjacent the external side surface 42 to prevent any solid and/or fluid from entering into the through hole 62 from the exterior area 68.

When the drain pipe 60 includes a plurality of longitudinal sections 80 connecting to each other into an end-to-end configuration, the step of installing at least one drain pipe 60 includes axially inserting a first one of the plurality of longitudinal sections 80 into the at least one through hole 62; and connecting a successive one of said plurality of longitudinal sections 80 to a previously inserted one said longitudinal section 80 into an end-to-end configuration, and axially inserting the successive section 60 into the through hole 62.

The method may also include the step of installing a vent pipe 88 adapted to vent gas away from the interior area 66. As shown in FIG. 3, the vent pipe 88 typically extends from the interior area 66 through the footing 14 and along the foundation wall 20 adjacent the external side surface 24 to above the ground level G adjacent the foundation wall 20.

As schematically shown in FIG. 1, the present invention is always preferably installed along with a bed of small rocks 90 surrounding the footing 14 to improve the flow of water away from the building, and also preferably extending down to either a main water reservoir 92 or the like from which the accumulated water can be drained away or a city drain pipe (not shown). When installed retroactively, it is preferable to temporarily increase the support of the building foundations via hydraulic rams assemblies 84 or the like removably secured all around to the foundation walls 20, since the soil is temporarily weakened around the footing 14. Each ram 84 typically includes a bracket 84*a* secured to the foundation wall 20. An adjustable hydraulic ram 84*b* is mounted between the bracket 84*a* and a rigid plate 84*c* (of typically about 2 feet square in size) firmly laying on the soil to ensure proper stability of the foundation wall 20 relative to the soil. The hydraulic rams assemblies 84 are usually removed just prior the refill of the cavity adjacent the foundation wall. Obviously, during retrofitting, since the external wall surface 24 of the foundation walls 20 are open to the air, cracks 86 found into the foundation walls 20 can easily be repaired to prevent more damages thereof. Also, once the internal area 66 below the slab 12 has been drained, vent pipes 88 are typically installed at a few locations along the foundation wall 20, and extending through the footing 14 and up above the ground level G, to allow any pressurized gas, such as radon coming from underground and the like, to properly escape the area 66, on a continuous basis.

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinafter claimed.

I claim:

1. A method for keeping water away from a main concrete slab partially sitting on an inside edge of a top surface of a footing relative to a foundation wall entirely sitting on the top surface of the footing adjacent the slab, the foundation wall having an external side surface facing away from the slab and an internal side surface facing towards the slab, the top surface having an outside edge thereof extending externally away from the external side surface and defining an external ledge of the footing therebetween, the external side surface of the foundation wall and the top surface of the footing defining an intersection therebetween, said method comprising the step of:

closing off the intersection to keep water away therefrom and from the concrete slab, including:

covering the intersection with a substantially solid joint, the joint being adapted to cover a first portion of the external side surface adjacent the intersection and at least a portion of the external ledge adjacent the intersection, said joint defining a free surface angled relative to both the external side surface and the top surface, in a cross section of the joint, the free surface, the first portion of the external side surface and the at least a portion of the external ledge forming a substantially triangular shape; and before the step of covering the intersection with a substantially solid joint, covering the external ledge, the first portion and a second portion of the external side surface adjacent and above the first portion thereof with an internal water resistant membrane adhering thereto.

2. The method of claim 1, wherein the step of covering the intersection with a substantially solid joint includes:

installing at least one wedge block over the intersection to form the joint.

3. The method of claim 2, wherein the at least one wedge block includes a plurality of wedge blocks, and wherein the step of covering the intersection with a substantially solid joint includes:

installing the plurality of wedge blocks over the intersection in a side-by-side fashion to form the joint.

4. The method of claim 2, further including, after the step of installing at least one wedge block, the step of:

covering the free surface and the internal water resistant membrane covering the second portion of the external side surface with an external water resistant membrane adhering thereto.

5. The method of claim 1, wherein the step of covering the intersection with a substantially solid joint includes:

pouring settable concrete material over the intersection to form a solid piece of concrete being the joint.

6. The method of claim 5, further including, after the step of pouring settable concrete material, the step of:

covering the free surface and the internal water resistant membrane covering the second portion of the external side surface with an external water resistant membrane adhering thereto.

7. A device for keeping water away from a main concrete slab partially sitting on an inside edge of a top surface of a footing and adjacent a foundation wall entirely sitting on the top surface of the footing adjacent the slab, the foundation wall having an external side surface facing away from the slab and an internal side surface facing towards the slab, the top surface having an outside edge thereof extending externally away from the external side surface and defining an external ledge of the footing therebetween, said device comprising:

a substantially solid joint adapted to be located adjacent and along an intersection of the external side surface of the foundation wall and the top surface of the footing, the joint entirely and sealably covering the intersection, and adapted to cover a first portion of the external side surface adjacent the intersection and at least a portion of the external ledge adjacent the intersection, said joint defining a free surface angled relative to both the external side surface and the top surface, in a cross section of the joint, the free surface, the first portion of the external side surface and the at least a portion of the external ledge forming a substantially triangular shape; and an internal water resistant membrane adhering to and covering the external ledge, the first portion and a second portion of the external side surface adjacent and above the first portion thereof, said internal water resistant member extending between the solid joint and both the first portion of the foundation wall and the external ledge of the footing;

wherein the joint closes off the intersection to keep water away therefrom and from the concrete slab.

8. The device of claim 7, further including an external water resistant membrane adhering to and covering the free surface and a second portion of the external side surface adjacent and above the first portion thereof.

9. The device of claim 7, further including a structural rod adapted to be located adjacent and along the intersection, the structural rod being entirely covered by the joint.

10. The device of claim 9, further including a plurality of spacers for spacing the structural rod from the foundation wall and the footing, said plurality of spacers being entirely covered by the joint.

11. The device of claim 10, wherein said plurality of spacers are anchors for anchoring the structural rod to the foundation wall and the footing.

12. The device of claim 7, wherein said joint is made out of settable concrete material.

13. The device of claim 7, wherein said joint includes at least one wedge block.

14. The device of claim 13, further including an attaching member for attaching said at least one wedge block to at least one of the footing and the foundation wall.

15. The device of claim 13, wherein said at least one wedge block includes a plurality of wedge blocks positioned in a side-by-side relationship relative to one another.

16. The device of claim 15, further including a fastener member securing adjacent ones of said plurality of wedge blocks to one another.

17. The device of claim 16, wherein said fastener member is a staple-type fastener.

18. The device of claim 13, wherein the free surface of said at least one wedge block is angled relative to the first portion of the external side surface with an angle being larger than zero degree and smaller than 90 degrees.

19. The device of claim 13, further including an external water resistant membrane adhering to and covering the free surface and the internal water resistant membrane covering the second portion of the external side surface.

20. The device of claim 19, wherein at least one of the internal and external water resistant membranes extending upwardly above a ground level and/or downwardly below the outside edge.

* * * * *